United States Patent [19]

Dewald

[11] 4,119,438

[45] Oct. 10, 1978

[54] PROCESS AND APPARATUS FOR REMOVING STRAWS FROM BOTTLES

[76] Inventor: Hans Dewald, Berliner Ring 76, 6806 Viernheim, Germany

[21] Appl. No.: 777,851

[22] Filed: Mar. 15, 1977

[30] Foreign Application Priority Data

Oct. 27, 1976 [DE] Fed. Rep. of Germany ..... 2648706

[51] Int. Cl.[2] ..... B08B 7/00

[52] U.S. Cl. ..... 134/6; 15/60; 134/25 R; 209/2; 209/361; 214/309

[58] Field of Search ..... 134/6, 25 R, 32; 15/59, 15/60, 67, 63, 65, 101; 209/1, 2, 359, 361; 214/309, 310, 301, 152

[56] References Cited

U.S. PATENT DOCUMENTS

| | | | |
|---|---|---|---|
| 944,986 | 12/1909 | Pindstofte | 15/63 |
| 1,020,510 | 3/1912 | Petz | 15/65 |
| 1,037,380 | 9/1912 | Weiss | 15/63 |
| 1,199,998 | 10/1916 | Linderme | 15/59 |
| 1,817,014 | 8/1931 | Meyer et al. | 15/60 |
| 3,545,024 | 12/1970 | Randruf | 15/60 |
| 4,061,236 | 12/1977 | Schneerson | 214/309 |

*Primary Examiner*—S. Leon Bashore
*Assistant Examiner*—George C. Yeung
*Attorney, Agent, or Firm*—Staas & Halsey

[57] ABSTRACT

A process and apparatus for removing straws from bottles employing a plurality of resilient blades which are mounted to rotate such that the ends thereof engage the straws within the bottles removing same.

10 Claims, 4 Drawing Figures

PROCESS AND APPARATUS FOR REMOVING STRAWS FROM BOTTLES

BACKGROUND AND SUMMARY OF THE INVENTION

The present invention relates to a process and apparatus for removing straws from empty bottles. In the refreshment industry large quantities of "reusable" bottles are returned, and must be washed thoroughly before being reused. Frequently, the bottles are returned with drinking straws and similar foreign matter extending outwardly from the mouths thereof. It will be apparent that the drinking straws must be removed from the bottles before the washing operation. The problem of removing the straws is frequently compounded as a result of the straws being bent or broken during packing and unpacking for transport.

With the present invention the drinking straws or other foreign materials are removed from the bottles as a result of the interaction of resilient blades against the straws. Different techniques may be used for mounting and orienting the resilient blades, and the straws after having been removed may be transported under the influence of air movement to a point of collection.

DESCRIPTION OF THE PREFERRED EMBODIMENT

Figure 1:
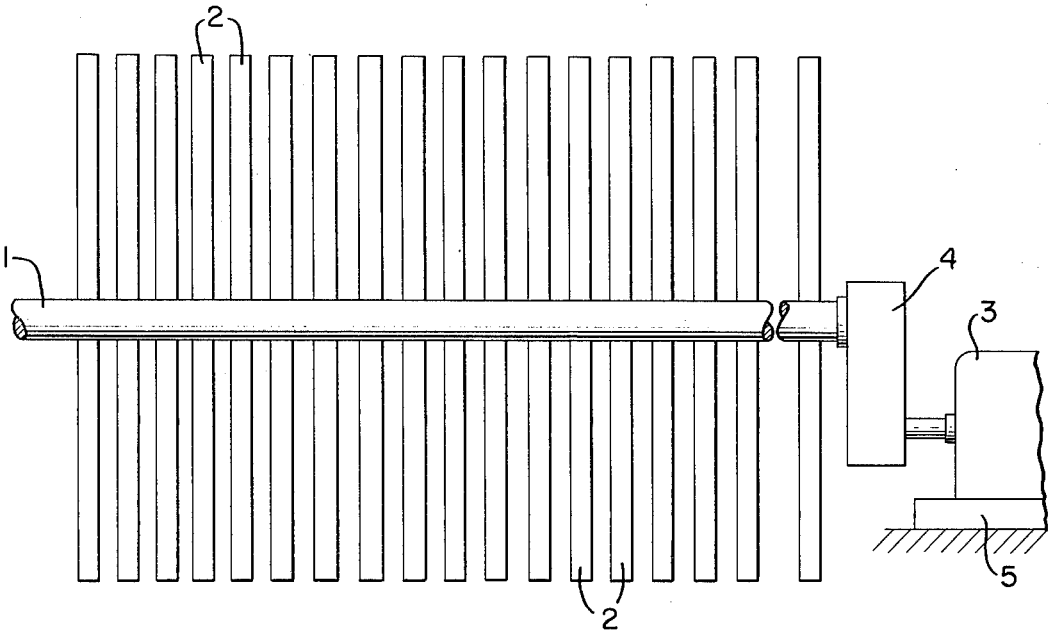
FIG. 1 is a side elevational view of a rotatably driven shaft provided with two opposing rows of equidistantly spaced, resilient impact blades.

As illustrated in FIG. 1, the apparatus of the present invention consists of a shaft 1, which may for example be round in cross-section, which carries two opposed rows of elongated, resilient impact blades or leaves 2 which are spaced equidistantly along the shaft 1. The shaft 1 is journalled for rotation in conventional manner, is driven by an electric motor 3 through a gear system 4, the motor 3 being mounted upon a foundation 5. The impact blades 2 are resilient and may be of rubber or any other elastic material.

Figure 2:
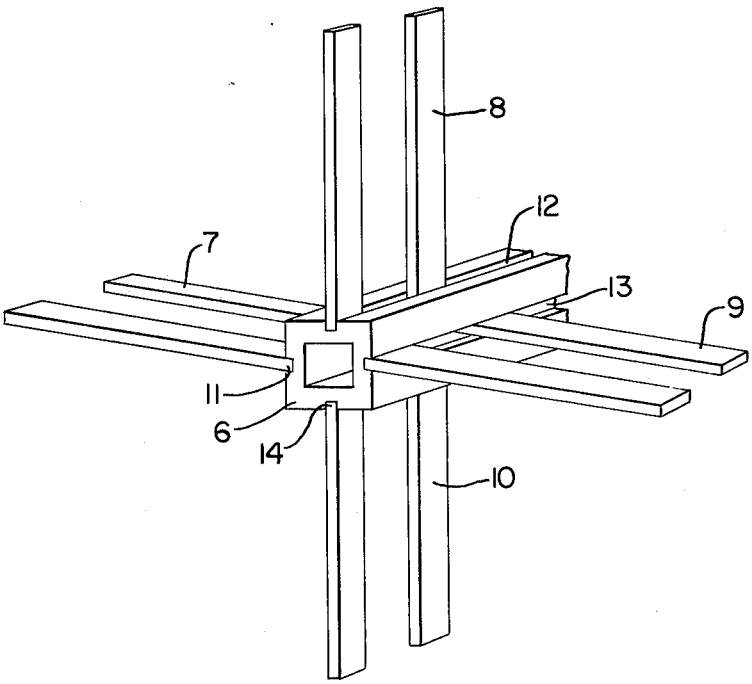
FIG. 2 is a perspective view of another embodiment of the present invention illustrating a rotatably mounted shaft which is square in cross-section and which is provided with four rows of longitudinal grooves within which the resilient, impact blades are positioned.

Turning now to FIG. 2, it will be apparent that the reference numeral 6 designates a shaft which is square in cross-section and which is designed to carry four rows of impact blades 7, 8, 9 and 10, each of the rows of blades being positioned 90° from each other. The impact blades 7, 8, 9, and 10 are positioned within grooves 11, 12, 13 and 14 provided in the shaft 6 along the longitudinal axis thereof.

Figure 3:
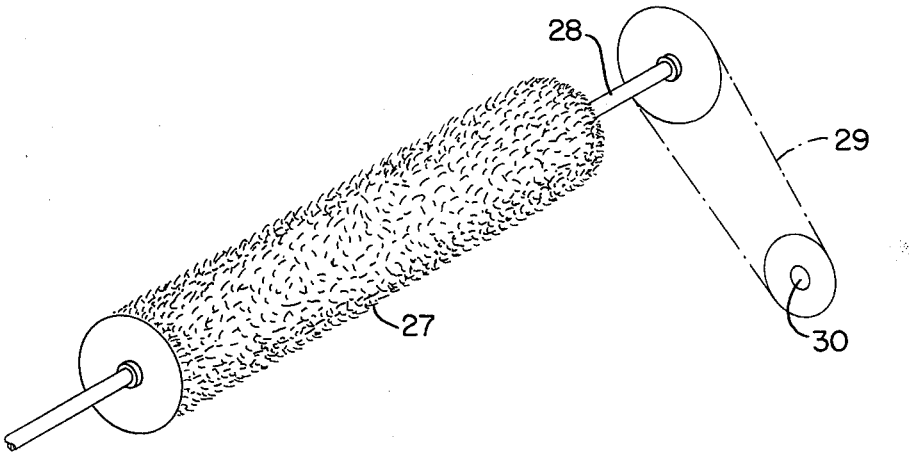
FIG. 3 is another embodiment of the present invention wherein the rotating shaft is provided with bristles for removing the straws.

Turning now to the embodiment of FIG. 3, the reference numeral 27 designates a plurality of bristles extending outwardly from a drum mounted on a shaft 28 which through the connection 29 is driven by the shaft 30 of a motor.

Figure 4:
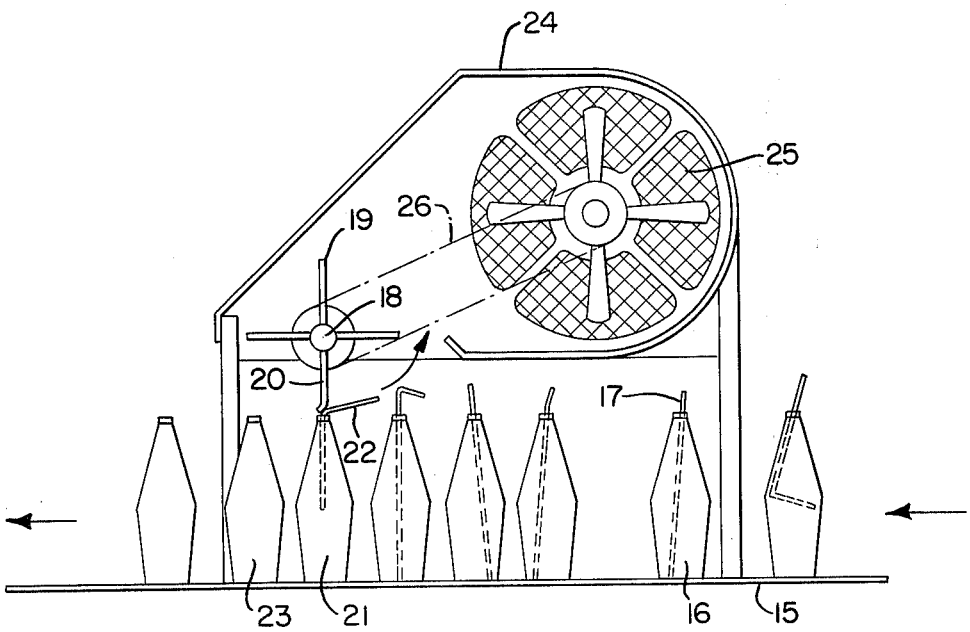
FIG. 4 is a side elevational view of one application of the principles of the present invention whereing there is shown a hood within which is mounted a ventilator, a conveyor for moving the bottles toward the washing station, and a plurality of rotatably mounted resilient impact blades which may be moved either clockwise or counterclockwise for the purpose of engaging and subsequently withdrawing the straws from the bottles, the straws thereafter being propelled by the ventilator to a point of collection.

Operation of the present invention is illustrated in FIG. 4, wherein it will be apparent that a conveyor 15 transports the bottles 16 having the drinking straws 17 therein. Positioned in advance of the washing and cleaning mechanism is a rotatably mounted shaft 18 which is provided with impact blades 19 and 20 and which is designed to be rotated in conventional manner by the motor of the ventilator 25 and the pulley 26. The shaft 18 and the impact blades 19 and 20 are covered by the hood 24 which is positioned in generally parallel relationship to the shaft 18 and which is appropriately supported.

As the bottles 16 move along with the conveyor 15 toward the cleaning mechanism they pass underneath the rotating impact blades 19 and 20. The shaft 18 is positioned such that when the impact blades 19 and 20 are vertical so as to be aligned with the longitudinal axis of the bottles 16 the bottoms of the blades 19 and 20 just contact the mouths of the bottles 16. Thus, as the shaft 18 rotates in a clockwise direction the impact blades 19 and 20 flip over the mouths of the bottles 16. During this action, the drinking straw 22 is engaged by the resilient impact blade 20 and pulled out of the bottle 21. Where the shaft 18 rotates counterclockwise, as illustrated in FIG. 4, the drinking straw 22 will move outwardly of the bottle 21 in the direction indicated by the arrow. It will also be apparent that operation of the ventilator 25 will cause the straws 22 that have been pulled out of the bottles 16 to be moved to a position where they may be collected. Thereafter, the bottles 23, from which the straws 22 have been removed, move with the conveyor 15 to the washing station.

From the foregoing it will be apparent that the construction, shape and number of the impact blades, and the structure for rotating same, may vary considerably, and the invention may be used with or without a fan or the configuration of the hood illustrated in FIG. 4.

I claim:

1. A process for removing straws from bottles, comprising the step of rotating a plurality of resilient blades into engagement with the straws without significant projection of said blades into said bottles, the impact of the blades against the straws removing the straws from the bottles.

2. A process for removing straws from bottles as in claim 1, further comprising the step of moving the straws that have been removed to a collection station under the influence of the movement of air.

3. A process for removing straws from bottles as in claim 2, further comprising the steps of transporting the straw containing bottles to the rotating plurality of blades, transporting the empty bottles from the rotating plurality of blades to a washing station, and washing the empty bottles.

4. An apparatus for removing straws from bottles, comprising a plurality of resilient blades, means mounting said blades for movement, and means positioning said bottles such that said blades engage the straws removing the straws from the bottles, without significant projection of said blades into said bottles.

5. An apparatus for removing straws from bottles as in claim 4, wherein said means mounting said blades for movement comprising a rotatably mounted shaft to which said blades are attached, and wherein said means positioning said bottles comprises a conveyor along which said bottles move.

6. An apparatus for removing straws from bottles as in claim 5, wherein said shaft and conveyor are arranged such that the ends of said blades contact said straws at the vicinity of the mouths of the bottles.

7. An apparatus for removing straws from bottles as in claim 5, wherein said blades comprise two rows of blades positioned longitudinally along said axis.

8. An apparatus for removing straws from bottles as in claim 5, wherein said blades comprise four rows of blades positioned longitudinally along said axis.

9. An apparatus for removing straws from bottles as in claim 5, wherein said blades comprise bristles extending outwardly from a drum mounted to said shaft.

10. An apparatus for removing straws from bottles as in claim 4, further comprising a ventilator and means positioning said ventilator in relationship to said bottles and blades to move the straws removed from said bottles to a collection point.

* * * * *